US007753641B2

(12) United States Patent
Seljestad

(10) Patent No.: US 7,753,641 B2
(45) Date of Patent: Jul. 13, 2010

(54) LATCH

(75) Inventor: Gregory A. Seljestad, Wamego, KS (US)

(73) Assignee: Caterpillar Inc, Peoria, IL (US)

( * ) Notice: Subject to any disclaimer, the term of this patent is extended or adjusted under 35 U.S.C. 154(b) by 394 days.

(21) Appl. No.: 11/403,495

(22) Filed: Apr. 13, 2006

(65) Prior Publication Data

US 2007/0243054 A1 Oct. 18, 2007

(51) Int. Cl.
*B66C 1/00* (2006.01)

(52) U.S. Cl. ..... 414/729; 37/406; 414/724

(58) Field of Classification Search ..... 414/729, 414/724, 912; 37/403, 406, 902; 172/272; 292/95, 121, 122, 128, 219, 228
See application file for complete search history.

(56) References Cited

U.S. PATENT DOCUMENTS

| | | | | |
|---|---|---|---|---|
| 5,111,602 | A | 5/1992 | Risch | |
| 5,553,408 | A | 9/1996 | Townsend | |
| 6,209,237 | B1 | 4/2001 | Heiple et al. | |
| 6,843,005 | B2 | 1/2005 | Clapper | |
| 2003/0024138 | A1* | 2/2003 | Frigon et al. | 37/406 |
| 2005/0042025 | A1 | 2/2005 | Miller et al. | |
| 2005/0188568 | A1* | 9/2005 | Clapper | 37/406 |

OTHER PUBLICATIONS

"Geith Hydraulic Auto-Lock Klamp, Operator and Service Instruction, Ref: 00041402A," Geith, Inc., 46 pages, published in the U.S. before Apr. 13, 2006.

"When You Need to . . . Get a Grip!, Rockland Bucket Thumbs, Series III BT-S and BT-H, Better Than Ever!," Rockland Manufacturing Co., 5 pages, published in the U.S. before Apr. 13, 2006.

* cited by examiner

*Primary Examiner*—Donald Underwood
(74) *Attorney, Agent, or Firm*—Andrew J. Ririe

(57) ABSTRACT

A latch is capable of automatically latching and unlatching an implement, such as a thumb used on the stick of a hydraulic excavator. The thumb may be moved to a stored, inactive position by the operator and automatically latched, or locked, in that position by the latch. To automatically engage the latch, and latch the thumb in its stored position, the operator moves the thumb to its stored position under the force of the thumb actuator. To automatically disengage the latch, and unlatch the thumb, the operator moves the thumb out of its stored position. The force of the thumb on the latch will overcome the latch's unlatching force. But unintentional drifting of the thumb will not cause a force great enough on the latch to overcome the unlatching force and disengage the latch. Also, the latch can be easily manually disengaged by a technician.

10 Claims, 5 Drawing Sheets

LATCH

TECHNICAL FIELD

This disclosure relates to latches. More specifically, this disclosure relates to latches for holding mining and construction machinery implements, such as a hydraulic excavator's thumb, in a stored position.

BACKGROUND

Mining and construction machinery employ various implements, such as buckets, rams, forks, grapples, thumbs, etc., to perform different operations. These implements are commonly attached to the machine with a movable joint such as a pin joint, and are moved relative to the machine by actuators. When the operation that an implement performs is not needed, an operator may desire to move the implement into a stored, inactive position.

For example, when a bucket and a thumb is attached to the stick of a hydraulic excavator, the operator may use the thumb to assist in grabbing material, like tree stumps or demolition debris, by pinching the material with the thumb against the bucket. But when the thumb is not needed for grasping material or other operations, and the operator wishes to use the bucket to dig, the operator may wish to move the thumb to a stored, inactive position. The thumb may be moved to such a stored, inactive position by curling the thumb backwards until it folds against the stick.

An implement may be moved relative to the machine into the stored, inactive position primarily through force applied to the implement by the actuator. The actuator could be a hydraulic cylinder or a lead screw, as non-limiting examples.

Some types of actuators may be capable of moving an implement to its stored, inactive position, but may not be suitable for holding the implement in that position. For example, a hydraulic cylinder could be used to curl a thumb on an excavator stick backwards towards the stick. The thumb can be stored there, in an out of the way position, until the thumb is needed again. But the hydraulic cylinder may not be suitable for holding the thumb in that position. A hydraulic cylinder can drift over time because of leakage of hydraulic fluid around seals and valves. If the hydraulic cylinder drifts, the implement will be unintentionally moved from its stored position. The excavator operator may be required to correct the drift of the thumb by commanding a corrective movement of the hydraulic cylinder. Frequently correcting this drift can be tedious and distracting for the operator.

Latches are sometimes used to lock implements in their stored, inactive position by preventing drift. Various latches for this purpose have been used and proposed. One simple type of latch is a manual pin which pins the implement to the machine. To latch an implement with this type of latch, the operator of the machine is typically required to leave the cab, get into position next to the implement to be latched, and manually insert a pin between the implement and the machine. Manual pins are not attractive because of the time and effort required by the operator to insert the pin.

Other latches, such as the one proposed in U.S. Pat. No. 6,209,237, assigned to Rockland, Inc., are automatic latches which can latch and/or unlatch an implement without requiring the operator to leave the cab. The automatic latch illustrated in the Rockland patent permits automatic latching of a thumb on an excavator in a stored, inactive position. To automatically latch the thumb, the thumb is first moved to the stored position by a hydraulic cylinder or other actuator. Moving the thumb into the stored position causes the latch to automatically engage, and the thumb to be automatically latched in the stored position. Latching is automatic because it can be accomplished by the operator commanding movement of the thumb into the stored position from within the excavator's cab. In addition, the automatic latch illustrated in the Rockland patent can automatically unlatch the thumb from its stored position. To automatically unlatch the thumb, the operator commands the hydraulic cylinder to apply a force to the thumb to move it away from the stored position. The force from the hydraulic cylinder overcomes the latch's unlatching force causing it to automatically disengage, and the thumb to be automatically unlatched.

While the latch in the Rockland patent provides automatic latching and unlatching and works with certain thumbs, it is not well suited to work with other thumbs. For example, the manner in which the latch in the Rockland patent is positioned may limit the locations where the cylinder for positioning the thumb can be attached to the stick. Also, it may be difficult for the latch in the Rockland patent to achieve an unlatching force great enough for very large and heavy thumbs. In addition, while the latch in the Rockland patent provides automatic unlatching, it is difficult to manually unlatch it. Manual unlatching of the Rockland patent's latch can require a relative large amount of force and be difficult. Easy manual unlatching is appreciated by technicians who may need to manually disengage the latch to move the thumb during a servicing operation.

In contrast, the latch of the present invention is well suited to work with many different types of thumbs and other implements, by being flexible in the way in which it is positioned relative to the implement, and by being able to achieve a relatively high unlatching force so it can be used with large and heavy thumbs and other implements. The latch of the present invention is also simple to construct, install, and maintain, inexpensive, and easier to manually unlatch than other automatic latches.

DETAILED DESCRIPTION

The following is a detailed description of one exemplary embodiment which will help illustrate the principles and applications of the invention. However, this exemplary embodiment is not intended to define the full scope of the invention because other embodiments are possible, as will be appreciated by those of ordinary skill in this art. The intended scope of the invention is defined by the attached set of claims.

Figure 1:
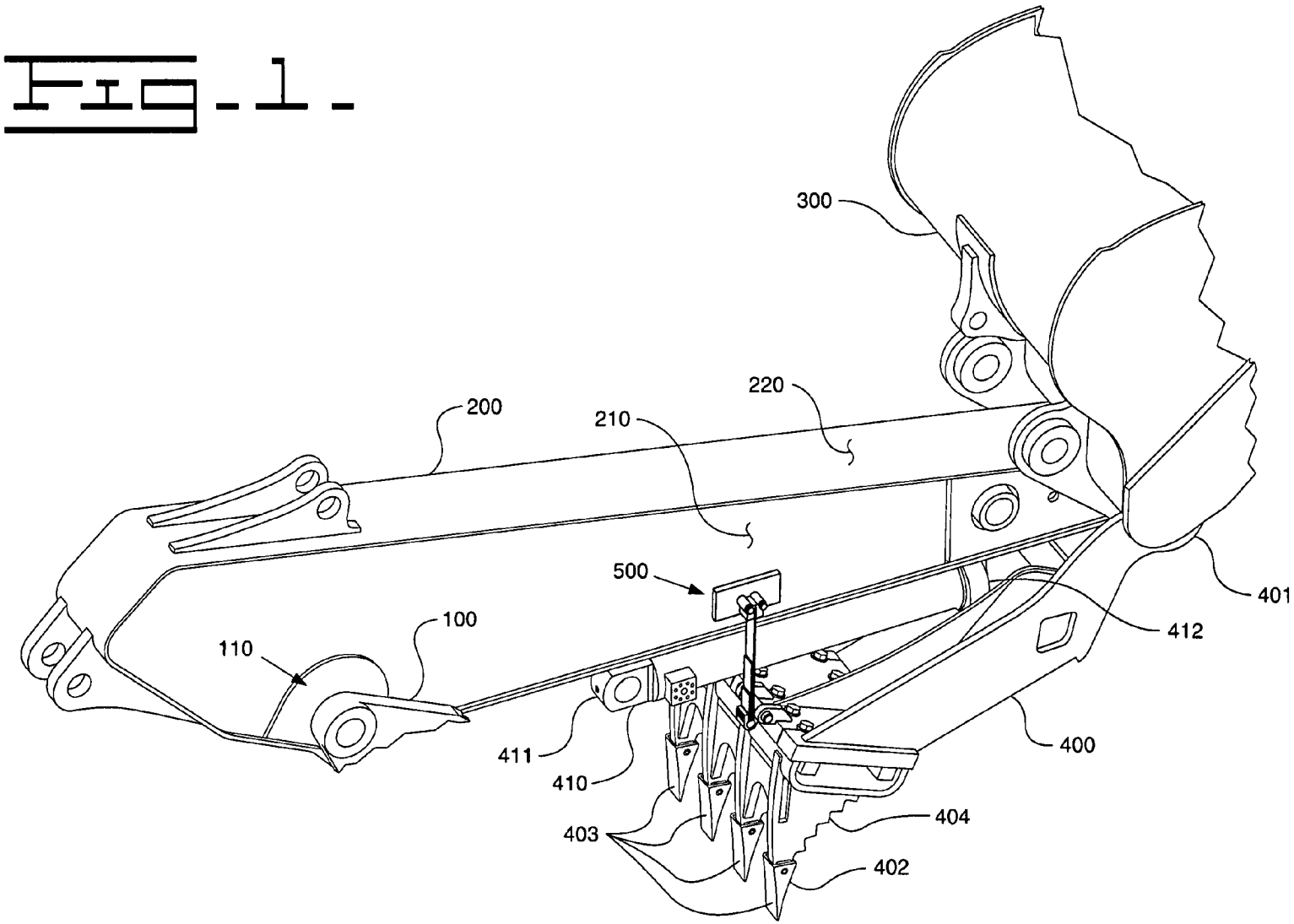
FIG. 1 is an isometric view of a hydraulic excavator stick, bucket, and thumb combination, and a latch exemplary of the present invention.

FIG. 1 illustrates a hydraulic excavator stick, bucket, and thumb combination where a latch according to the present invention is used to hold the thumb in a stored, inactive position relative to the stick. The figures and the specification use this environment to demonstrate one use of the latch. Of course, other uses of the latch are possible, including use as a latch for an excavator, back hoe, or wheel loader bucket, or use as a latch for other implements on construction or mining machinery. As will be recognized by those of ordinary skill in this art, the latch could be used in any environment where latching is desired. Thus, the depiction of a hydraulic excavator stick, bucket, and thumb combination to demonstrate the invention should not be understood as a limitation to the scope of the invention. As already explained, the intended scope of the invention is defined by the attached set of claims.

In FIG. 1, an excavator boom 100 is partially shown. The excavator boom 100 is attached to a hydraulic excavator (not shown) in a standard fashion. A stick 200 is pivotally mounted to the excavator boom 100 at pin joint 110 in a standard fashion. A bucket 300 is pivotally mounted to the stick 200 at a pin joint (not shown) in a standard fashion. The bucket 300 may be used to dig, scoop, and carry material such as soil and rock from a digging site, and dump it in a pile or in a truck. Hydraulic cylinders (omitted from the figures), or other types of actuators, may be used to further connect the boom 100 to the excavator, the stick 200 to the boom 100, and the bucket 300 to the stick 200 in a standard fashion.

A thumb 400 is also pivotally mounted to the stick 200 at a pin joint (not shown). The thumb 400 may be mounted at a first end 401 thereof to the stick 200 at the same pin joint for mounting the bucket 300 to the stick. Or, the thumb 400 may be mounted to the stick 200 at a separate pin joint. A hydraulic cylinder 410 further connects the thumb 400 to the stick 200. Another type of actuator may be used in place of hydraulic cylinder 410. One end 412 of hydraulic cylinder 410 is connected to the thumb 400. The other end 411 opposite end 412 is connected to the stick 200 in any desirable manner (the connection of end 411 to stick 200 has been omitted). As the length of hydraulic cylinder 410 increases or decreases, thumb 400 rotates, or curls, relative to the stick 200. In the setup illustrated in the figures, the thumb 400 and bucket 300 may be moved independently of one another, with separate actuators. The thumb 400 may include at its second end 402, opposite the first end 401, a set of teeth 403 adapted for digging, cutting, chiseling, or pinching. Teeth 403 can be permanent, or removable and replaceable. An area of serrations 404 can also be formed on the second end 402 of the thumb 400. The serrations can assist the thumb in grasping an object.

The thumb 400 can be used cooperatively with the bucket 300 to trap an article or material in between, thereby assisting the bucket in picking up and transporting a load. This operation could be used, for example, to pick up a stump or a log and place it in a truck in a land clearing operation. The thumb 400 can be used in many other ways as well, and very effectively extends the capability and increases the efficiency of the excavator.

During certain operations, the thumb 400 may not be required. In fact, in some operations, the thumb 400 can impede proper use of the bucket 300. For these operations, an operator desires to curl the thumb 400 to a stored, inactive position where it will be out of the way of the movement of bucket 300 and will not contact boom 100. The orientation of the thumb 400 relative to the stick 200 in FIG. 1 is an example of a stored, inactive position.

The hydraulic cylinder 410, or other actuator, can be used to curl the thumb 400 backwards towards the stick 200 and into this stored, inactive position. However, the hydraulic cylinder 410, in some conditions, may not be capable of retaining the thumb 400 in this position. Hydraulic cylinders, and other actuators, too, can drift over time and permit unintentional movement of the thumb 400. To correct the drift and unintentional movement of the thumb 400, the operator may need to repeatedly actuate the hydraulic cylinder 410 to force the thumb 400 back into the stored position. This corrective movement can be tedious and distracting to the operator.

Latch 500 operates between the thumb 400 and stick 200 to lock, or latch, the thumb in its stored position. As will be understood by those of skill in this art, latch 500 could also be used in other, different applications.

Figure 2:
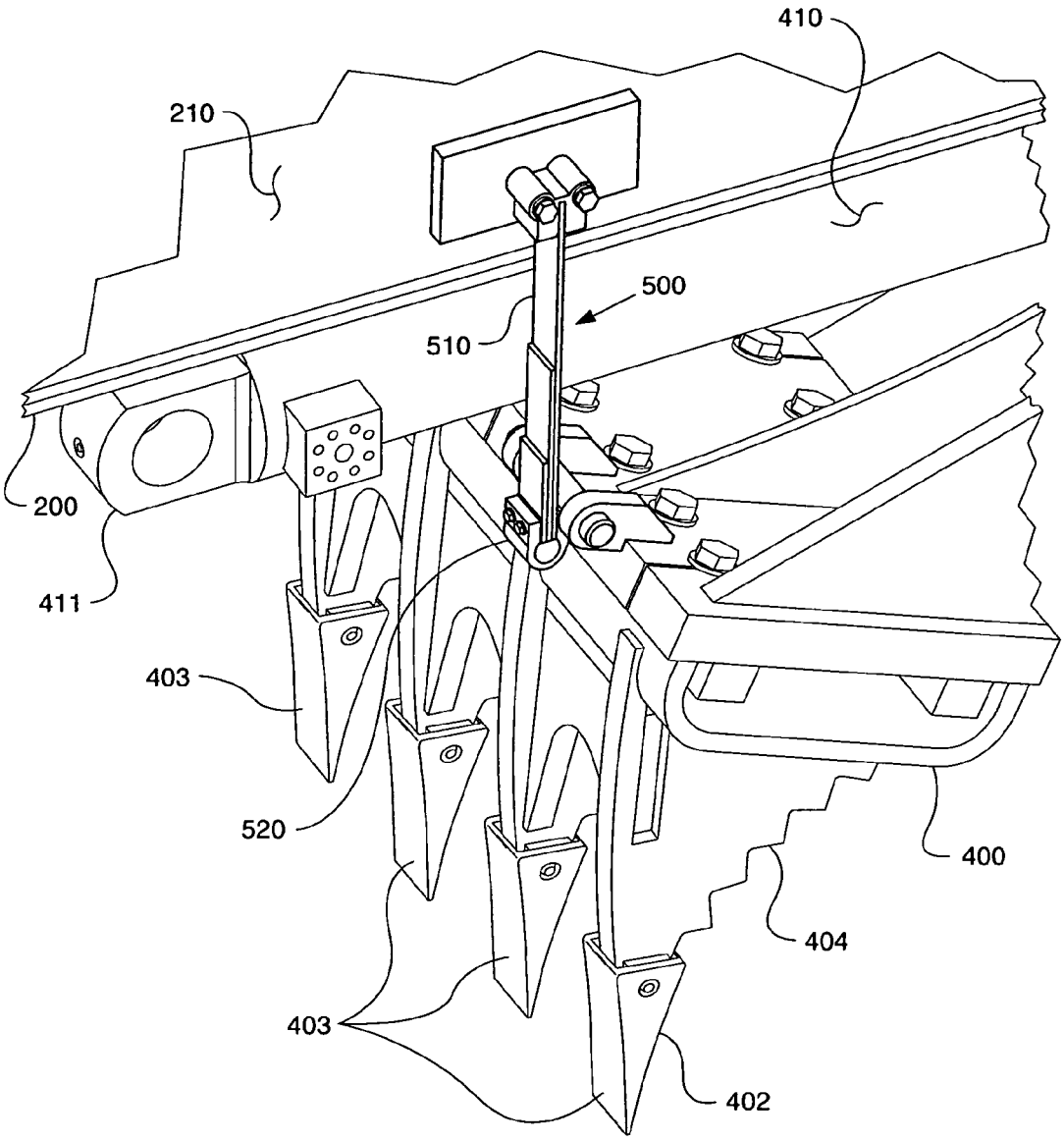
FIG. 2 is a close-up of the latch of FIG. 1.
Figure 3:
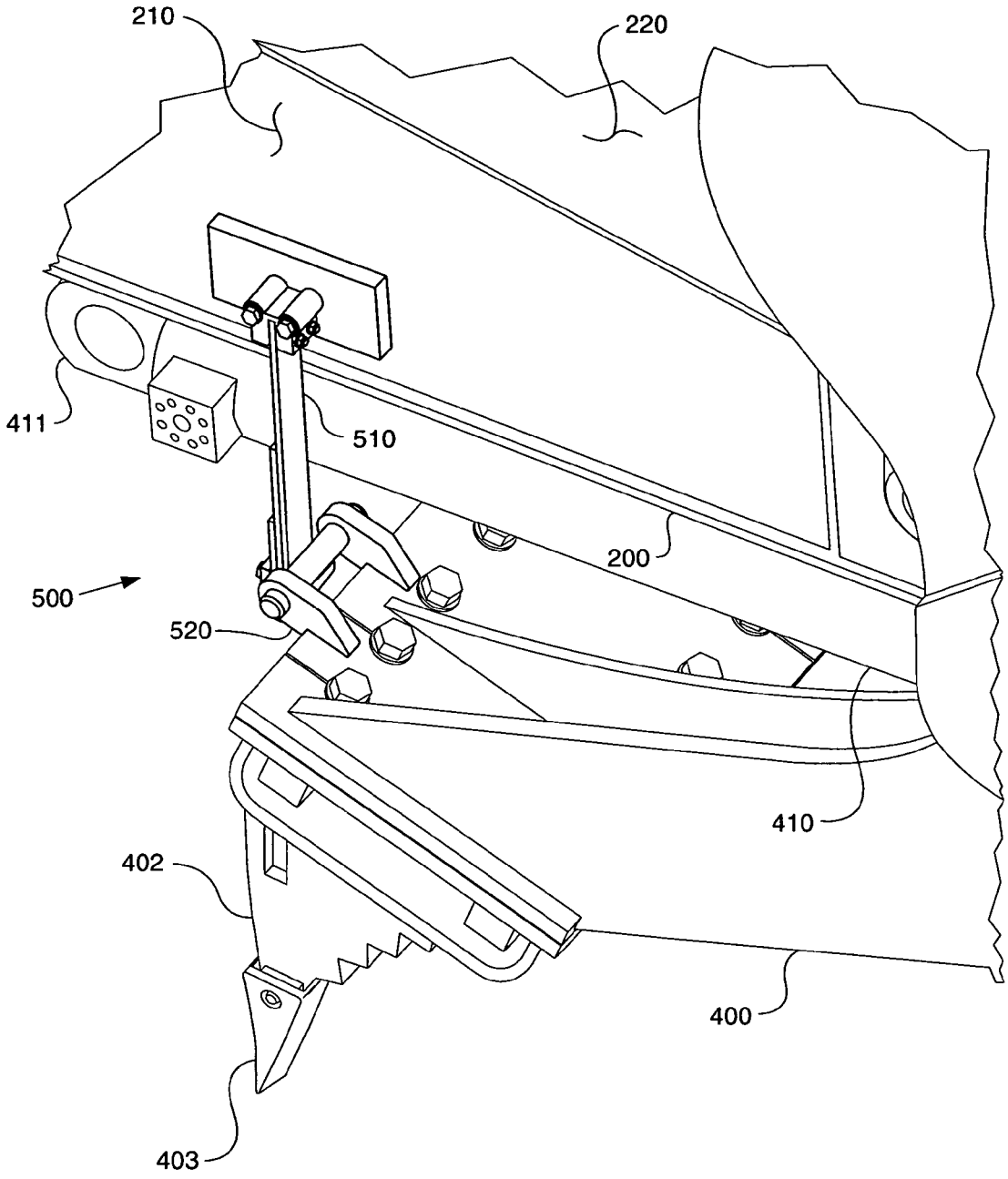
FIG. 3 is another close-up isometric view of the latch of FIG. 1.

With reference now to FIGS. 2 and 3, the latch 500 may comprise a hook assembly 510 and a lock assembly 520. In the illustrated application, one of the hook assembly 510 or lock assembly 520 should be attached to the excavator stick 200, and the other of the hook assembly 510 or lock assembly 520 should be attached to the thumb 400. Preferably, the hook assembly 510 is attached to the stick 200, and the lock assembly 520 is attached to the thumb 400.

An advantageous mounting position for the hook assembly 510 is to a side plate 210 of stick 200. Stick 200 is a box section welded with a top plate 220, bottom plate (not shown), and two side plates 210 (only one shown). Bucket 300 and thumb 400 rotate around axes that pass through each of the side plates 210. Hook assembly 510 is mounted to one of the side plates 210 so that it will not impede curling the thumb 400 backwards and into a stored position tight against the stick 200. The position of the latch on the bottom plate of the stick dictated by the design in the Rockland patent (U.S. Pat. No. 6,209,237, referenced above) is not advantageous. With the latch attached to the middle of the bottom plate, the hydraulic cylinder for the thumb cannot be mounted to the stick at a point past where the end of the thumb reaches when the thumb is curled to the storage position, or else the latch and hydraulic cylinder would interfere. Latch 500, set up as shown in FIGS. 2 and 3, permits greater flexibility in using the latch with varying types of thumb arrangements, because it does not interfere with the mounting of a thumb's hydraulic cylinder to the stick.

Figure 4:
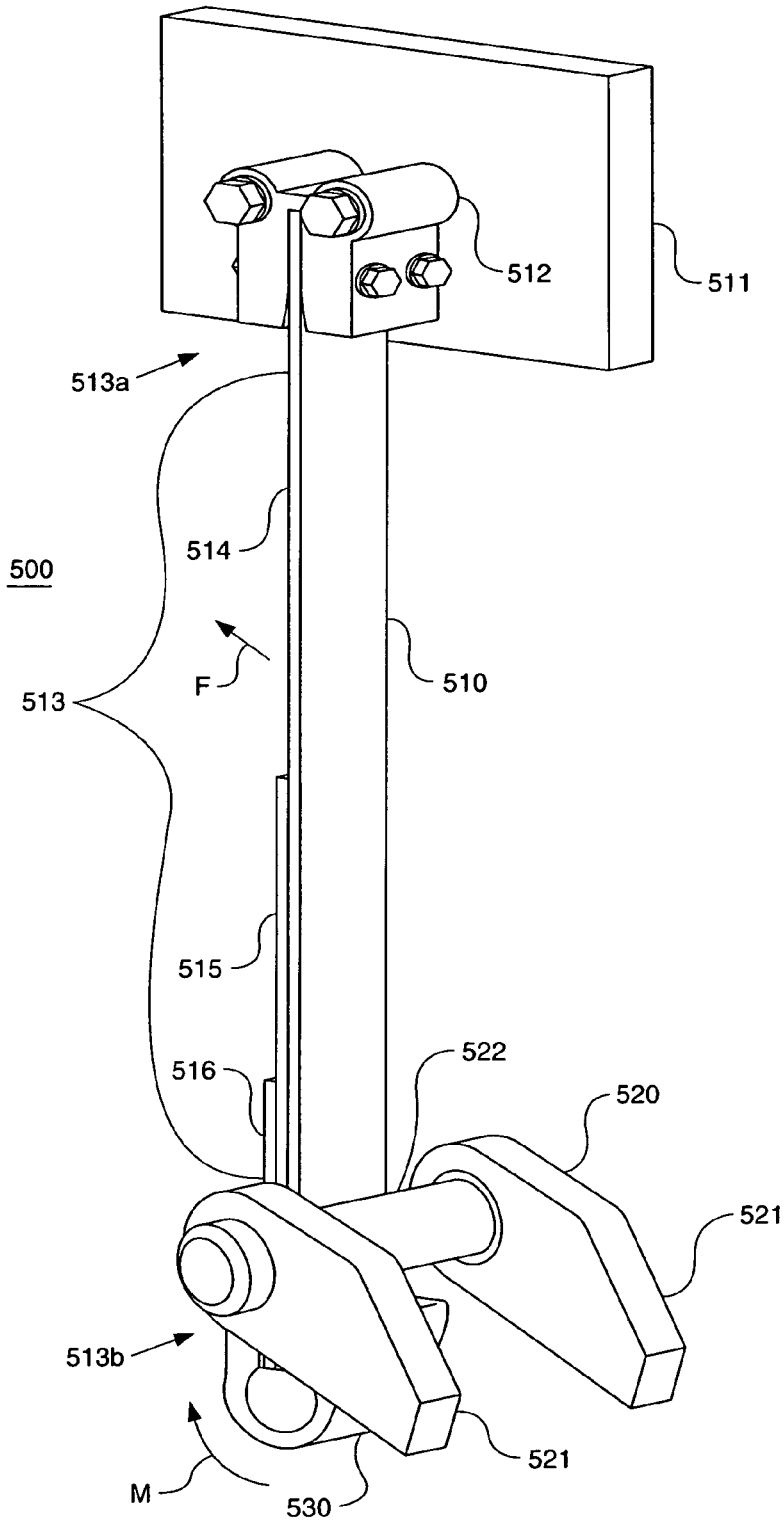
FIG. 4 is an isometric view of the latch of FIG. 1 shown alone, detached from the excavator.
Figure 5:
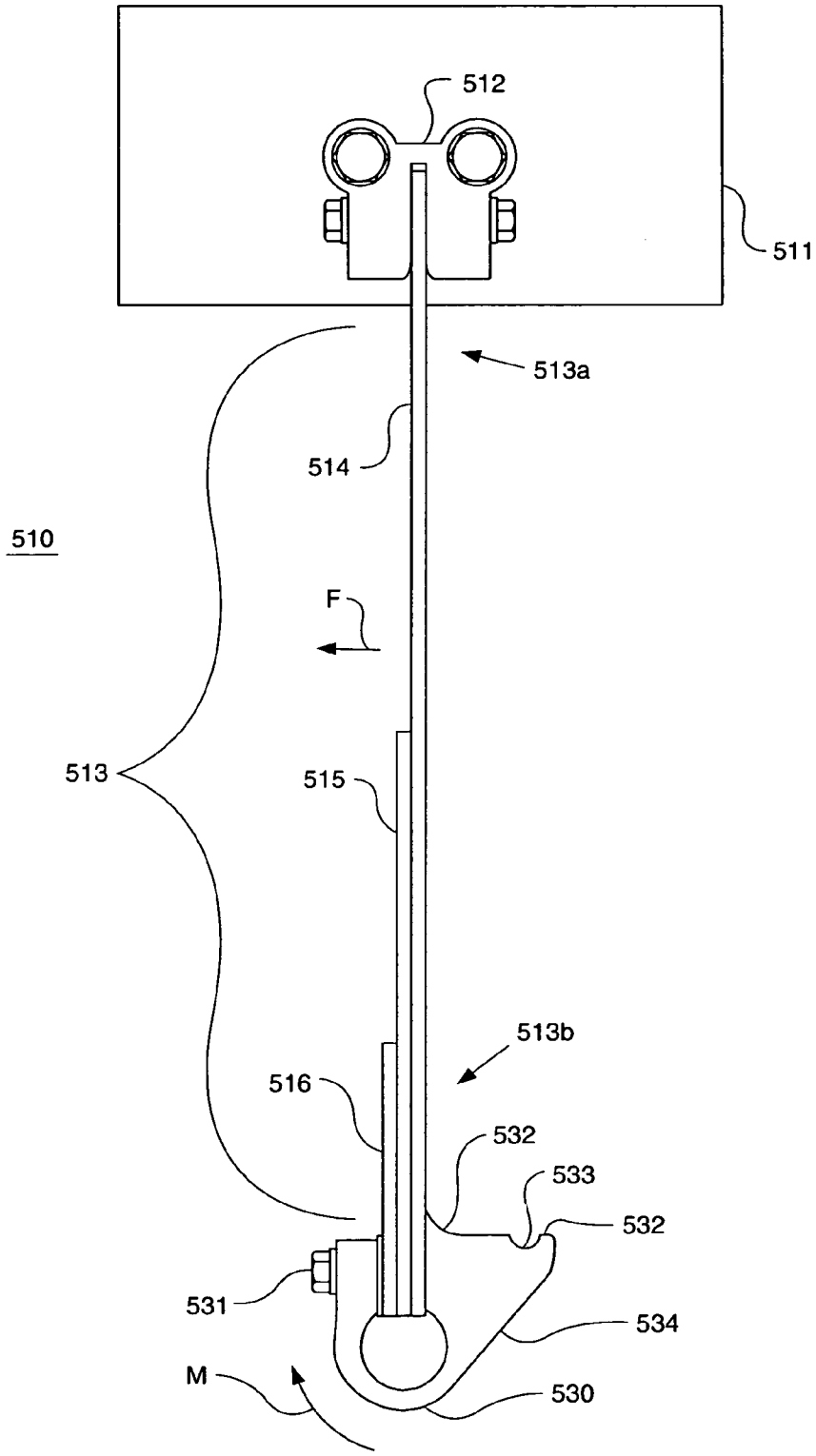
FIG. 5 is a plan view of a portion of the latch of FIG. 4.

With reference now to FIGS. 4 and 5, the hook assembly 510 comprises a mount, an elongated, compliant extension arm, and a hook. The mount could be any size or shape, as will be recognized by those of ordinary skill in this art, and may be adapted for a particular application. In the illustrated embodiment, the mount is mounting plate 511. Mounting plate 511 is adapted to be easily positioned on, and welded or bolted to the side plate 210. In the illustrated embodiment, the mounting plate 511 is a rectangular metal plate, and includes a clamping fixture 512. Clamping fixture 512 may be used to clamp and firmly hold a first end of the elongated compliant extension arm.

In the illustrated embodiment, the elongated, compliant extension arm is formed by a leaf spring assembly 513. Other structures may be used for the compliant extension arm, including possibly a coil spring. The type of extension arm to be used can be selected and adapted for a particular application, as will be understood by those of ordinary skill in this art. The extension arm spaces a hook 530 from the mount. The extension arm is also compliant so that the hook may move during latch engagement and disengagement. Preferably, the extension arm has a resistance to bending, or stiffness, that is variable along its length. The purpose of this varying stiffness is explained below.

A first end 513*a* of the leaf spring assembly 513 is held by the clamping fixture 512. A second end 513*b* of leaf spring assembly 513, opposite the first end 513*a*, is mounted to the hook 530. Hook 530 can be firmly attached to the end of leaf spring assembly 513 by clamping on two sides of leaf spring assembly 513, as shown in FIG. 5 with fastener 531. Other methods of attachment could also be used. Hook 530 includes a hook surface 532 having a detent 533. A camming surface 534 is formed adjacent and partially underneath hook surface 532.

Leaf spring assembly 513 may include one or more plates of flexible material, such as steel. The plates have a thickness which is less than their width. In the figures, three plates 514, 515, and 516 are illustrated as an example. Each plate 514, 515, and 516 is attached to the hook 530. The length of each plate 514, 515, and 516 is successively shorter. The length is measured in the direction of elongation between the mounting plate 511 and the hook 530. Only plate 514 is attached to mounting plate 511. Plates 515 and 516 only span part of the distance from the hook 530 to mounting plate 511. The effective thickness of the leaf spring assembly 513 increases with the addition of successive plates 515 and 516 moving downward from the mounting plate 511 to the hook 530. The increasing effective thickness of leaf spring assembly 513 results in the variable stiffness. The stiffness of leaf spring assembly 513, at least in the direction the hook is displaced during latch engagement and disengagement, is greater near the hook 530 than near the mounting plate 511. This varying resistance to bending could be accomplished in other ways, such as by increasing the actual thickness of leaf spring assembly 513, instead of increasing the effective thickness through the addition of additional plates. This varying resistance to bending could also be accomplished by increasing the width of the leaf spring assembly 513 along its length, for example making the width near the hook 530 greater than the width near the mounting plate 511.

Turning now to the lock assembly 520 illustrated in FIGS. 3 and 4, the lock assembly is attached near end 402 of the thumb 400. Lock assembly 520 may include a pair of spaced plates 521. Lock assembly also includes a locking member which will contact the hook 530 during latch engagement and disengagement. In the illustrated embodiment, the locking member is a rod 522 fixed and suspended between the plates 521. Other structures could be used for the locking member, as will be understood by those of ordinary skill in this art, and, of course, other structures could be used to position the rod 522. The rod 522 is illustrated in the figures as round in cross-section, but other shapes may be used.

Automatic Latching

To automatically engage the latch 500, and automatically latch the thumb in its stored position, the thumb 400 is curled backward toward the stick 200 under force of the hydraulic cylinder 410. The rod 522 swings toward hook 530 on the backward curling motion of the thumb 400. Rod 522 first contacts hook 530 at camming surface 534. The oblique angle of the motion of rod 522 relative to the camming surface 534 creates a force on hook 530 in the direction of arrow F in FIGS. 4 and 5. The force on hook 530 created by the rod 522 and camming surface 534 causes the leaf spring assembly 513 to bend, permitting the hook 530 to displace to the left in the orientation of FIGS. 4 and 5. Eventually, the rod 522 slides past camming surface 534, and the hook 530 springs back into the position depicted in FIG. 4. This is the engaged position of the latch 500, and the latched position of thumb 400. The latching force is the force required to be exerted on the hook 530 by the rod 522 during latching to displace the hook an adequate distance to permit the rod to slide past.

Automatic Unlatching

To automatically disengage the latch 500, and automatically unlatch the thumb 400 from its stored position, the thumb is curled away from the stick with the hydraulic cylinder 410. The rod 522 contacts the hook surface 532. The motion of rod 522 is almost normal to the hook surface 532. Thus, the force of the rod 522 against the hook surface 532 initially creates very little force in the direction of the arrow F to displace the hook 530. A detent 533 may be provided on the hook surface 532 to ensure that the rod 522 contacts the hook surface at an angle that initially creates very little force in the direction of arrow F.

As the force of the rod 522 against the hook surface 532 builds, a moment is created about the hook 530, in the direction of the arrow M in FIGS. 4 and 5, tending to rotate the hook in a clockwise direction in the orientation of FIGS. 4 and 5. Only a relatively large force on the hook 530 will cause rotation, however, because the resistance to bending of the leaf spring assembly 513 near the hook is relatively high. As the hook 530 rotates slightly in the direction of arrow M, the hook surface 532 is also rotated slightly. As the hook surface 532 is rotated slightly, the angle of the motion of the rod 522 against the hook surface changes. This results in the components of force of the rod 522 against the hook 530 to remain primarily in a downward direction parallel to the leaf spring assembly 513, but also results in an increasing force exerted on the hook in the direction of arrow F, and normal to the leaf spring assembly. The small force in the direction of the F arrow causes the leaf spring assembly 513 to bend in the direction of the force. The bending will occur mostly near the first end 513*a* of leaf spring assembly 513 attached to mounting plate 511, because the resistance to bending in the direction of arrow F is less in that area of the assembly. Thus, for a relatively high force of the rod 522 against the hook surface 532, only slight rotation of the hook in the direction of arrow M and displacement in the direction of arrow F results. Eventually, a great enough force of the rod 522 against the hook surface 532 will cause the hook 530 to displace in the direction of arrow F a distance which will permit the rod 522 to slide off of hook surface 532—this force is the unlatching force. When unlatched, thumb 400 can be freely curled forward under the force of the hydraulic cylinder 410 and used for operations in combination with the bucket 300.

If the thumb 400 drifts downward, or is purposefully curled forward by the hydraulic cylinder 410, the thumb will be stopped when rod 522 contacts the hook surface 532 until the latch's 500 unlatching force is overcome.

Due to the difference in angles between the camming surface 534 and the hook surface 532 relative to the motion of the rod 522, the unlatching force is many times greater in magnitude than the latching force.

Manual Unlatching

Due to the relationship between the rotation of the hook 530 and bending of the leaf spring assembly 513, a relatively small resistance of the leaf spring assembly to bending in the direction of arrow F can counteract a very large force of the rod 522 against hook surface 532. This results in the ability to easily manually disengage the latch 500 and unlatch the thumb 400, by a person grasping the hook 530 and pulling it in the direction of arrow F to move the hook past rod 522. The force required to pull the hook 530 past rod 522 could be as low as 30 lbs., while a force one hundred times (100×) that or more may be required to be exerted by the rod on the hook to overcome the latch's unlatching force and automatically unlatch the thumb. Only purposeful movement of the thumb 400 with the hydraulic cylinder 410 commanded by the operator will create a force on the latch 500 great enough to overcome the unlatching force. Unintentional drifting of the thumb 400, even if the thumb is relatively large and heavy, will not overcome the unlatching force and disengage the latch 500.

The ability to automatically unlatch the thumb 400 is appreciated by operators because the unlatching can be accomplished without leaving the cab. The ability to easily manually unlatch the thumb 400 is appreciated by technicians who may need to unlatch and move the thumb during a servicing operation, when power from the hydraulic cylinder 410 may not be available.

INDUSTRIAL APPLICABILITY

The latch 500 may be used to hold the thumb 400 in an stored, inactive position when it is not needed. The latch 500 will automatically unlatch the thumb 400 when the operator purposefully moves the thumb from its stored position, the force of the thumb actuator on the latch causing the latch to disengage. The latch 500 is resistant to a relatively high unlatching force, so that drift of the thumb 400 is prevented. Only purposeful actuation of the thumb actuator will overcome the latching force and cause automatic unlatching. Yet latch 500 also permits easy manual unlatching by a technician. Each of these features can help improve the utility of a machine such as a hydraulic excavator.

I claim:

1. A machine comprising:

a box-section stick comprising a top plate, bottom plate, and a pair of side plates connecting the top plate and bottom plate;

a bucket mounted to the stick for rotational movement relative thereto, the bucket adapted to dig and scoop material;

a thumb mounted to the stick for rotational movement relative thereto independent of the bucket, the thumb arranged to pinch articles against the bucket; and a latch having a compliant extension arm which is mounted to one of the pair of side plates, and a locking member which is mounted to one of the compliant extension arm and the thumb.

2. A method of automatically latching and manually unlatching a thumb on a hydraulic excavator, the method comprising:

curling the thumb backwards toward the excavator's stick, the thumb being curled backwards under the force of a thumb actuator;

displacing a hook and a compliant extension arm mounted to one of the thumb or the stick with a locking member mounted to the other of the thumb or the stick to engage the latch;

holding the thumb in a stored position relative to the stick with the latch; and, manually disengaging the latch by a technician pulling on the extension arm or hook and bending the extension arm so that the hook moves through a non-circular arc and the locking member moves past the hook.

3. A machine according to claim 1 wherein:

the locking member exerts a latching force against the extension arm to bend the extension arm in a first direction and engage the latch;

the locking member exerts an unlatching force against the extension arm to bend the extension arm in the first direction and disengage the latch; and, the latching force is less than the unlatching force.

4. A machine comprising:

a first structure;

an implement mounted to the first structure for rotational movement relative thereto;

a latch including an elongated, compliant extension arm, a hook, and a lock;

the compliant extension arm having a first end and an opposite second end, the first end being fixed to the first structure so that the compliant extension arm may bend but not rotate relative to the first structure, the hook being mounted to one of the second end of the compliant extension arm and the implement, and the lock being mounted to the other of the second end of the compliant extension arm and the implement;

wherein when the implement rotates relative to the first structure, the lock and the hook engage and the compliant extension arm bends in a first direction, the second end of the compliant extension arm moving through a non-circular arc in response to the bending, until the lock slides past the hook and then the second end of the compliant extension arm returns to an unbent position.

5. A machine according to claim 4 wherein the compliant extension arm has a varying resistance to bending in the first direction that varies along its length, the varying resistance to bending being greater near the second end than near the first end.

6. A machine according to claim 5 wherein the compliant extension arm comprises a leaf spring, the leaf spring comprising a plurality of plates having a thickness less than a width, each of the plurality of plates extending fully to the second end, but less than the plurality of plates extending fully to the first end.

7. A machine according to claim 6 wherein:

the hook comprises a camming surface and a hook surface having a detent.

8. A machine according to claim 4 wherein the hook is mounted to the second end of the compliant extension arm, and the lock is mounted to the implement.

9. A machine according to claim 8 wherein:

the hook comprises a camming surface and a hook surface.

10. A machine according to claim 9 wherein the hook moves in the first direction a distance sufficient to allow the locking member to slide by the camming surface and the latch to engage when a latching force is applied by the locking member to the hook;

the hook moves in the first direction a distance sufficient to allow the locking member to slide by the hook surface and the latch to disengage when an unlatching force is applied by the locking member to the hook; and the unlatching force is greater than the latching force.

* * * * *